US010278437B2

(12) United States Patent
Murphy

(10) Patent No.: US 10,278,437 B2
(45) Date of Patent: May 7, 2019

(54) WATER RESISTANT HANDWEAR

(75) Inventor: Robert Murphy, San Diego, CA (US)

(73) Assignee: SEIRUS INNOVATIVE ACCESSORIES, INC., Poway, CA (US)

( * ) Notice: Subject to any disclaimer, the term of this patent is extended or adjusted under 35 U.S.C. 154(b) by 0 days.

(21) Appl. No.: 12/325,127

(22) Filed: Nov. 28, 2008

(65) Prior Publication Data

US 2009/0172865 A1 Jul. 9, 2009

Related U.S. Application Data

(60) Provisional application No. 60/990,610, filed on Nov. 27, 2007.

(51) Int. Cl.
*A41D 19/00* (2006.01)

(52) U.S. Cl.
CPC ..... *A41D 19/0006* (2013.01); *A41D 19/001* (2013.01); *A41D 2400/20* (2013.01)

(58) Field of Classification Search
CPC ..... A41D 19/0006; A41D 19/001; A41D 2400/20
USPC ..... 2/16, 20, 161.1, 161.6, 163
See application file for complete search history.

(56) References Cited

U.S. PATENT DOCUMENTS 4,663,784 A * 5/1987 Ash ..... A41D 19/00 2/159
4,847,918 A 7/1989 Sturm
4,925,732 A 5/1990 Driskill et al.
5,020,161 A 6/1991 Lewis, Jr. et al.
5,123,119 A 6/1992 Dube
5,244,716 A 9/1993 Thornton et al. ..... 428/198
5,402,540 A 4/1995 Williams
5,442,818 A 8/1995 Loos ..... 2/272
5,483,703 A 1/1996 Williams
5,560,044 A 10/1996 Masley
5,566,405 A 10/1996 Masley
5,568,656 A 10/1996 Kim
5,569,507 A 10/1996 Goodwin et al.
5,655,226 A 8/1997 Williams
5,687,424 A 11/1997 Masley
(Continued)

FOREIGN PATENT DOCUMENTS

CN 1396810 2/2003 ..... A41D 19/00
JP 5947620 3/1959 ..... A41D 19/00
(Continued)

OTHER PUBLICATIONS

International Searching Authority, Patent Cooperation Treaty, International Search Report, dated Jan. 29, 2009.
(Continued)

*Primary Examiner* — Katherine M Moran
(74) *Attorney, Agent, or Firm* — Hayes Soloway P.C.

(57) ABSTRACT

A method for forming water resistant and breathable handwear is disclosed. The method includes the steps of: providing an outer shell, a liner that inhibits the transfer of heat from a user's hand, and a water resistant and breathable insert; applying a heat activated adhesive to a finger portion of the outer shell and the liner; assembling the outer shell, insert, and liner; and curing or activating the heat activated adhesive to form a bond between the layers. Water resistant handwear made through the process are also disclosed.

14 Claims, 7 Drawing Sheets

(56) References Cited

U.S. PATENT DOCUMENTS

| | | | | |
|---|---|---|---|---|
| 5,700,544 | A | 12/1997 | Goodwin et al. | |
| 5,732,413 | A | 3/1998 | Williams | |
| 5,740,551 | A * | 4/1998 | Walker | A41D 19/0006 2/16 |
| 5,804,011 | A | 9/1998 | Dutta et al. | |
| 5,822,795 | A * | 10/1998 | Gold | 2/159 |
| 5,832,539 | A | 11/1998 | Williams | |
| 5,911,313 | A * | 6/1999 | Gold | 2/159 |
| 5,981,019 | A | 11/1999 | Goodwin et al. | |
| 6,012,170 | A * | 1/2000 | Kim | 2/164 |
| 6,154,886 | A | 12/2000 | Hottner | |
| 6,395,383 | B1 | 5/2002 | Maples | |
| 6,415,447 | B1 * | 7/2002 | Frazier | 2/165 |
| 6,571,397 | B1 | 6/2003 | Williams | |
| 6,716,778 | B1 | 4/2004 | Hottner | |
| 6,807,683 | B2 | 10/2004 | Williams | |
| 6,855,171 | B2 | 2/2005 | Morlacchi | |
| 7,162,748 | B2 * | 1/2007 | Hottner | A41D 19/001 2/161.6 |
| 7,229,670 | B2 | 6/2007 | Williams | |
| 7,803,438 | B2 * | 9/2010 | Flather et al. | 428/35.7 |
| 2003/0115679 | A1 | 6/2003 | Morlacchi et al. | |
| 2003/0167555 | A1 | 9/2003 | Han | |
| 2004/0025221 | A1 | 2/2004 | Clark | |
| 2004/0040087 | A1 | 3/2004 | Lack et al. | |
| 2005/0076418 | A1 | 4/2005 | Von Blucher | |
| 2005/0144696 | A1 | 7/2005 | Lack et al. | |
| 2006/0065353 | A1 | 3/2006 | Williams | |
| 2006/0068140 | A1 | 3/2006 | Flather et al. | 428/36.1 |
| 2006/0117457 | A1 | 6/2006 | Williams et al. | |
| 2006/0156451 | A1 | 7/2006 | Klein et al. | |
| 2006/0195969 | A1 * | 9/2006 | Ragan et al. | 2/164 |
| 2008/0121835 | A1 | 5/2008 | Morlacchi | |
| 2009/0172865 | A1 | 7/2009 | Murphy | 2/163 |
| 2010/0018636 | A1 | 1/2010 | Ostani | |
| 2012/0137405 | A1 | 6/2012 | Murphy | 2/169 |

FOREIGN PATENT DOCUMENTS

| | | | |
|---|---|---|---|
| JP | 57144144 | 9/1982 | G06F 3/147 |
| JP | H11514707 | 12/1999 | A41B 11/00 |
| JP | 2000514877 | 11/2000 | A41D 19/00 |
| JP | WO2009119663 A1 | 1/2009 | |
| JP | 5226079 | 3/2013 | A41D 19/04 |
| WO | WO 92/17332 | 10/1992 | B32B 7/04 |
| WO | WO9716082 | 5/1997 | A41B 11/00 |
| WO | WO9747212 | 12/1997 | A41D 13/10 |
| WO | WO 01/56415 | 8/2001 | A41D 19/00 |
| WO | WO2009070789 | 6/2009 | A41D 19/00 |

OTHER PUBLICATIONS

International Searching Authority, Patent Cooperation Treaty, Written Opinion of the International Searching Authority, dated Jan. 29, 2009.

Japanese Office Action, dated Feb. 16, 2012 (7 pgs).

Chinese (Second) Official Action + English translation, dated Jun. 18, 2012 issued in Application No. 200880118020.1.

Extended European Search Report issued in corresponding European Patent Appln. Serial No. 08854099.2 dated Apr. 16, 2014 (6 pgs).

European Official Action, issued in related European Patent Application Serial No. 08 854 099.2-1705, dated Jan. 25, 2016 (5 pages).

Canadian Office Action issued in application 2,706,308, dated Dec. 7, 2015 (4 pgs).

Canadian Official Action issued in corresponding Canadian Patent Application No. 2,706,308 dated Feb. 9, 2015 (3 pgs).

Korean Office Action (w/translation) issued in application No. 10-2010-7013349, dated Feb. 23, 2015 (11 pgs).

Notice of Allowance issued in related Canadian Patent Application. No. 2,706,308 dated Dec. 9, 2016 (1 pg).

Notice of Intent to Grant issued in related EP Patent Application No. 08 854 099.2 dated Dec. 7, 2016 (8 pgs).

Opposition issued in related EP application No. 08854099.2 dated Feb. 2, 2018, 28 pages.

U.S. Appl. No. 13/286,107, filed Oct. 31, 2011, Murphy.

* cited by examiner

WATER RESISTANT HANDWEAR

CROSS-REFERENCE TO RELATED APPLICATIONS

This application claims the benefit of Provisional Application No. 60/990,610 filed Nov. 27, 2007, the entirety of which is incorporated herein by this reference for all purposes.

BRIEF SUMMARY OF THE INVENTION

The present invention is directed to water resistant handwear and to methods of forming the water resistant handwear.

A first example embodiment of the invention is a method for forming handwear which is water resistant and breathable. The method first generally includes the steps of: providing a shell sized for positioning over the hand of a user, said shell having a shell outer surface which is the outer surface of said handwear and a shell inner surface opposite the shell outer surface; and providing a liner formed of a material configured to inhibit the transfer of heat, said liner having a liner outer surface for positioning against the hand of a user and a liner inner surface opposite the liner outer surface. The method also includes the step of providing an insert that is water resistant and breathable, the insert having a first surface orientable towards the shell inner surface and a second surface orientable towards the liner inner surface. A heat activated adhesive is applied on at least one of the liner inner surface and the second surface of the insert and on at least one of the shell inner surface and the first surface of the insert. The insert is then assembled with the liner and the shell so that the second surface of the insert is adjacent to the liner inner surface and the first surface of the insert is adjacent to the shell inner surface. Finally, the assembled shell, insert, and liner are heated to activate the heat activated adhesive to bond the insert to each of the shell and the liner.

In various embodiments of the invention the adhesive is applied to only select areas between the shell or liner and the insert. For example, in one embodiment said heat activated adhesive is applied to portions of the liner and to portions of the shell that are to be oriented toward the palm of the user while in another embodiment said heat activated adhesive is applied to portions of the liner and to portions of the shell that are to be oriented toward the side of the handwear opposite the palm of the user. In another embodiment said heat activated adhesive is applied to the portion of the liner and to the portion of the shell to be oriented toward the fingers of the user. In yet another embodiment said heat activated adhesive is applied to the side portions or side panels of the finger portions of the shell and liner.

The heat activated adhesive is preferably powder or liquid prior to being heated and solid after being heated so that the adhesive does not prevent the insert from moving with respect to the shell and liner until the adhesive is activated to bond the layers. This allows wrinkles and folds to be removed from the liner and to assure proper alignment of the parts. For example, the heat activated adhesive may need to be heated to a temperature from about 150 degrees Fahrenheit or more for a period of time from about 5 seconds to about 45 seconds to completely activate the adhesive and bond the layers.

Thus, the above example embodiment may preferably include the step of smoothing the insert between the shell and liner to remove folds or gathers in the insert prior to completely heating the assembled shell, insert, and liner to activate the heat activated adhesive to bond the insert to each of the shell and the liner.

In another variation of this embodiment the handwear is a glove and said shell and said liner each include at least two finger portions having side portions therebetween. The heat activated adhesive is preferably applied to these side portions because folds or poor breathability caused by adhesives are less of a concern in those areas. In one embodiment the adhesive is applied exclusively to the thumb and side portions of the fingers. In another embodiment the side portions are assembled side panels, or fourchettes, used to form a desired shape of the glove.

In another variation of this embodiment, the step of providing a shell further comprises providing said shell configured with the outer surface oriented inwardly and the inner surface oriented outwardly; the step of applying said heat activated adhesive to said shell inner surface further comprises applying said heat activated adhesive to portions of said inner surface of said shell; and the step of assembling the shell with the insert and the liner comprises reconfiguring said shell with the outer surface oriented outwardly and the inner surface oriented inwardly with said inner surface of said shell oriented toward and adjacent said first surface of said insert.

Another preferred embodiment of the invention is a glove. The glove preferably includes: a liner formed of a material configured to inhibit the transfer of heat, said liner having a liner outer surface for positioning against the hand of a user and a liner inner surface opposite the liner outer surface, said liner being formed to have a palm portion for orientation proximate the palm of a user and with thumb and finger portions sized to receive the thumb and fingers of a user, the finger portions having respective side portions adjacent one another; a shell having an inner surface and an opposite outer surface oriented outwardly, said shell being formed to have a palm portion for orientation proximate the palm of a user and with thumb and finger portions sized to receive the thumb and fingers of a user, at least one of said finger portions having respective side portions adjacent one another; an insert that is water resistant and breathable, the insert having a first surface oriented towards the shell inner surface and a second surface oriented towards the liner inner surface; a first portion of heat activated adhesive bonding said side portions of said inner surface of said shell to said second surface of said insert; and a second portion of heat activated adhesive bonding said fourchette of said inner surface of said liner to said first surface of said insert.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

The drawings are not necessarily to scale.

DETAILED DESCRIPTION OF THE PREFERRED EMBODIMENTS

Reference will now be made to the drawings to describe various aspects of exemplary embodiments of the invention. It is to be understood that the drawings are diagrammatic and schematic representations of such exemplary embodiments, and are not limiting of the present invention, nor are they necessarily drawn to scale.

In the following description, numerous specific details are set forth in order to provide a thorough understanding of the present invention. It will be obvious, however, to one skilled in the art that the present invention may be practiced without these specific details. In other instances, well-known aspects of fabrics, water resistant inserts, and methods of forming articles of clothing such as handwear have not been described in particular detail in order to avoid unnecessarily obscuring the present invention.

Figure 1:
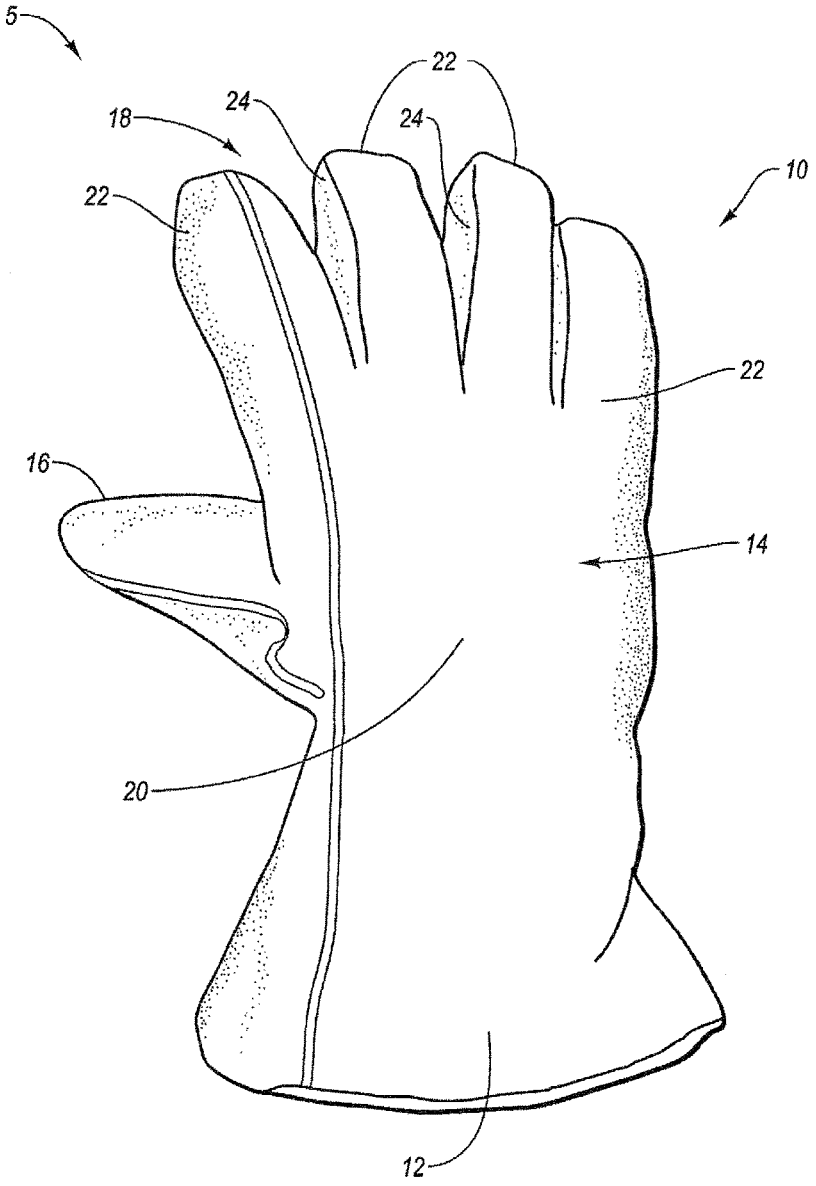
FIG. 1 illustrates a rear view of a glove according to one embodiment of the invention.
Figure 2:
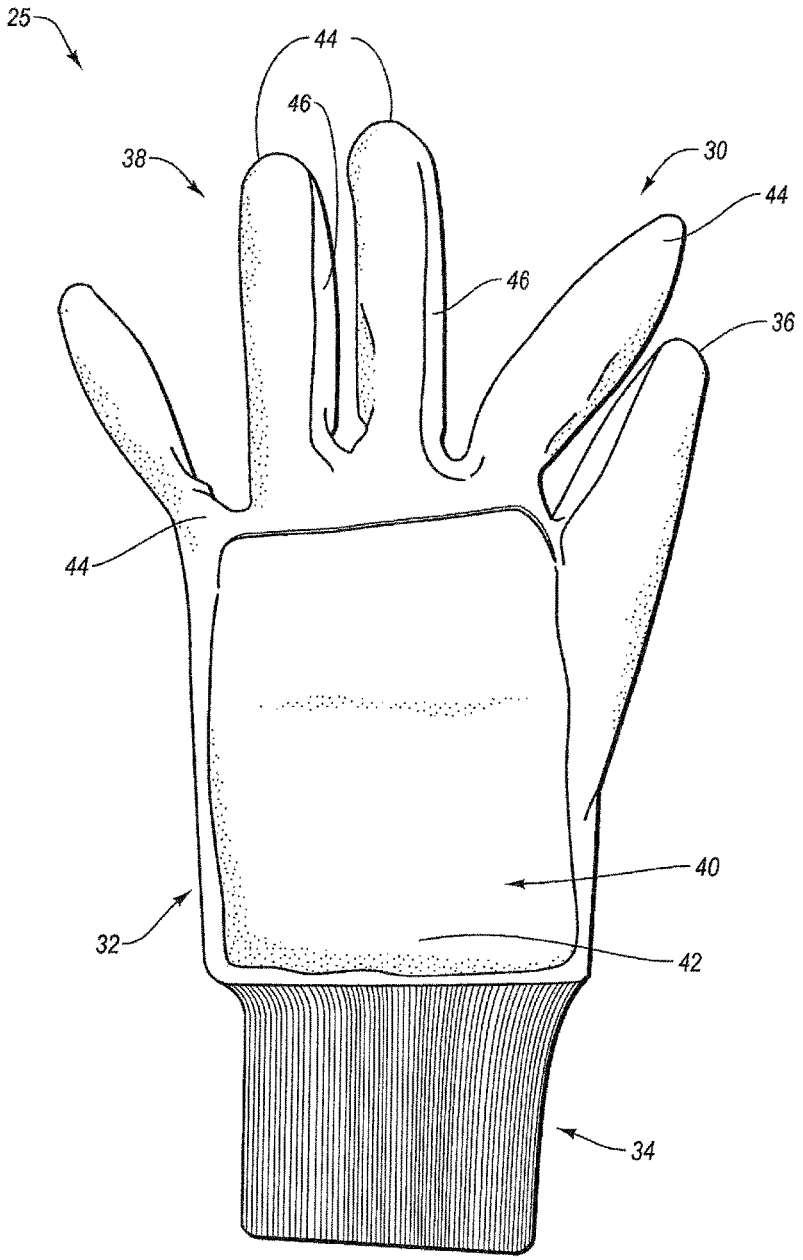
FIG. 2 illustrates a front view of a glove according to one embodiment of the invention.

With reference now to FIGS. 1-2, gloves 5, 25 with outer shells 10, 30, respectively, with an interior sized to receive a hand of a user are illustrated. The invention is not limited to gloves, however, and embodiments of the invention can be implemented with other forms of handwear such as mittens, mitts, shells, gauntlets, and other similar handwear, as will be apparent to those skilled in the art in view of the disclosure herein.

FIG. 1 is a view of the back, or opposite the palm, side of the glove 10, which generally includes wrist portion 12, body or hand portion 14 to receive the hand of the user, thumb portion 16 to receive the thumb of a user, and fingers portion 18 to receive the fingers of the user. Body, portion 14 includes back hand portion 20 and a palm portion (not illustrated in FIG. 1). Fingers portion 18 includes at least one finger member; in the embodiment of FIG. 1 four finger members 22 are illustrated, although it will be understood that other embodiments of fingers portion 18 include fewer finger members 22, such as a mitten that has no finger members 22 and possibly no thumb portion 16, one finger member 22, such as with shooting mitts that have an index finger, and other such variations. In the depicted embodiment the fingers portions 18 further include side portions, more particularly as depicted fourchette members 24 between the finger members 22. In this embodiment, the fourchette members 24 are discrete elements from the finger members 22, such as a separate piece of fabric or material stitched to the finger members 22. However, it is understood that other embodiments of the fourchette members 24 include a contiguous or unitary piece of fabric or material with finger members 22.

FIG. 2 is a front, or palm side, view of a glove 25 with outer shell 30 according to another embodiment of the invention. Whereas glove 5 has wrist portion 12 formed continuously with body or hand portion 14 in what is sometimes referred to as a gauntlet style, glove 25 has separate body portions 32 and wrist portions 34. A body or hand portion 32 to receive the user's hand includes a back hand portion (not illustrated) and a palm portion 40. In one embodiment the palm portion 40 has as palm patch 42 (formed of PVC, leather, rubber, silicon, and other similar materials, by way of non-limiting example) affixed thereto to provide wear resistance. Glove 25 also generally includes thumb portion 36 to receive a user's thumb and a fingers portion 38 to receive a user's fingers, although as discussed above the presence of finger portions 38 and thumb portion 36 varies with the type of glove, mitten, mitt, and other handwear. Fingers portion 38 includes at least one finger member 44. In the embodiment of FIG. 2 four finger members 44 are illustrated. In the depicted embodiment the finger members 44 further include fourchette members 46 between the finger members 44 similar to the fourchette members 24 discussed above.

Figure 3A:
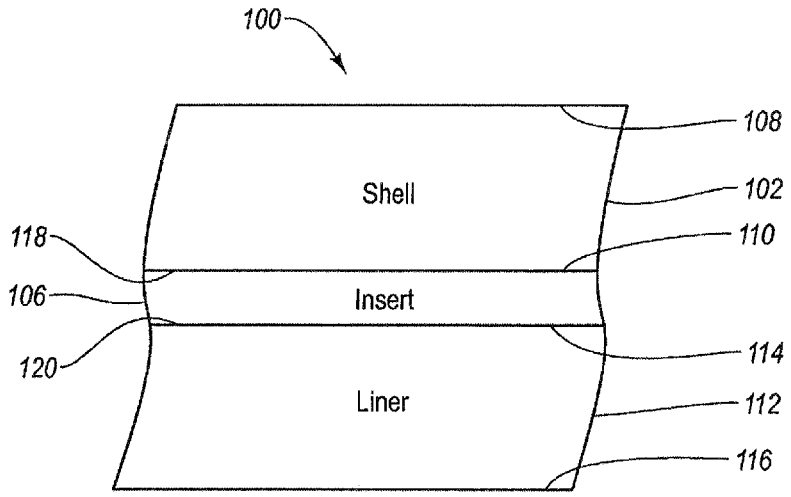
FIG. 3A illustrates a partial cross-sectional view of a first region of a glove according to one embodiment of the invention.
Figure 3B:
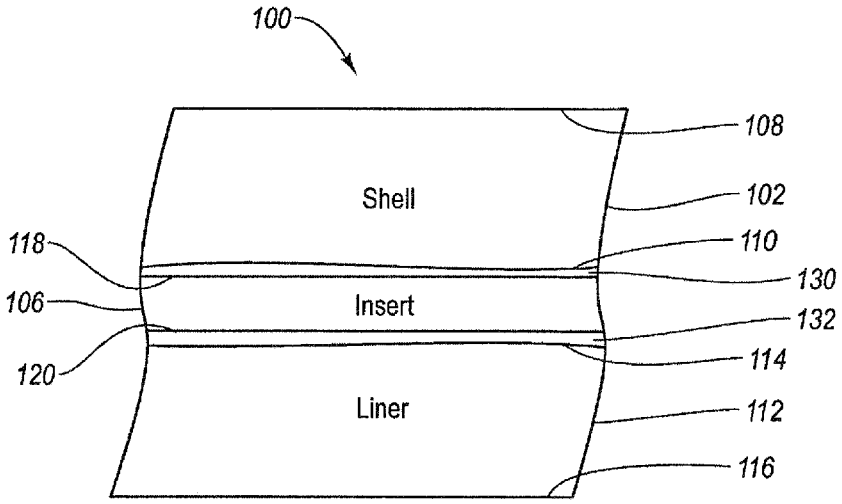
FIG. 3B illustrates a partial cross-sectional view of a second region of a glove according to another aspect of the invention.

With reference now to FIGS. 3A and 3B, the layered structure of a first region 100 of glove 5, 25 is illustrated in block form in FIG. 3A. The laminate structure of a second region of glove 5, 25 is depicted in block form in FIG. 3B.

In each of FIGS. 3A and 3B the layered structure 100 includes a shell 102 and a liner 112 with a water resistant and breathable insert 106 therebetween. In practice, the shell 102 forms the outer layer, or outer shell 10, 30 of the handwear 5, 25 in FIGS. 1-2, respectively. The liner 112 forms the inward layer that will contact a user's hand, and the insert 106 provides a water resistant characteristic to the handwear while preserving breathability. Thus, the shell 102 is preferably sized for positioning over the hand of a user and has a shell outer surface 108 that forms the outer surface of the outer shell 10, 30 and a shell inner surface 110 opposite the shell outer surface 108. Materials that can be suitably used to form shell 102 are well known in the art and may include both single and multi-layered materials such as fabrics or other flexible materials, such as fleece, neoprene, wool with Lycra®, and similar materials, as well as leather and other materials. The shell 102 is also preferably formed from multiple pieces as is known to those skilled in the art of glove making, for example including either separate or unitary wrist, body, thumb, finger, and fourchette regions, although a unitary shell 102 can be formed and used with certain embodiments of the invention.

The finer 112, in turn, is preferably formed of a material configured to inhibit or slow the transfer of heat from a user's hand to the environment and provide comfort to a user's hand. Thus, the liner 112 has a liner outer surface 116 for positioning against the user's hand and a liner inner surface 114 opposite the liner outer surface 116. The liner 112 can also be formed of single or multilayer materials such as, by way of non-limiting example, fleece, fleece layered with neoprene, wool with Lycra®, and similar materials. Like the shell 102, the liner 112 is also preferably formed from multiple pieces as known to those skilled in the art of glove making, for example including either separate or unitary wrist, body, thumb, finger, and side panel (fourchette) regions, although a unitary liner 112 can be formed and used with certain embodiments of the invention.

Insert 106 provides water resistant and/or breathable characteristics to the handwear that are not imparted by the shell 102 or the liner 112. The insert 106 can be described as having a first surface 118 oriented towards the shell 102 and, more particularly, towards the shell inner surface 110. The insert 106 also has a second surface 120 oriented towards the liner 112 and, more particularly, towards the liner inner surface 114.

Suitable materials for the insert are preferably pliant and resistant to liquids such as water but breathable to air and vapor, such as perspiration. Preferred inserts are formed of a polyurethane, such as thermoplastic polyurethane material, and elastomers made from polyester, polyamides, and other suitable membranous material have the desired physical characteristics known in the art.

As illustrated in FIG. 3B, layers of heat activated adhesive 130, 132 can be positioned between the insert 106 and the shell 102 and between the insert 106 and the liner 112. The heat activated adhesive 130, 132 is applied at a thickness sufficient to bond the adjacent layers without providing excess and undesirable thickness. Heat activated adhesives are well known in the art, and one is selected that will melt or activate at a temperature higher than is encountered by a user in normal activities but lower than the melt or burn temperatures of the other materials used to form the glove.

According to the invention the heat activated adhesive is preferably not used to bond the insert 106 to the shell 102 and liner 112 at all the locations they are adjacent. This is because, while the heat activated adhesive layers 130, 132 maintains the structural integrity of the glove, it is less breathable than the other layers and may also cause undesirable folds or bunching in the insert 106, as will be discussed in further detail below.

In one example embodiment the heat activated adhesive is only used to bond the side portions, or the fourchette regions of the shell and liner, respectively, to adjacent sections of the insert. In another embodiment, the heat activated adhesive is used to bond the finger portions, including any individual fingers, if present, and thumb portion, if present, of the shell and the liner, respectively to the insert. In these embodiments in which the heat activated adhesive is applied to the fourchette, finger, and thumb portions, the heat activated adhesive is applied to substantially just those regions. Substantially just those regions means, in this instance, that while some overspray of adhesive may inadvertently be applied to other portions or regions of the handwear, such as the back hand portion or palm portion, an effort is made to prevent adhesive from being applied to those other regions or portions. In other words, the heat activated adhesive purposefully is not used on the back hand portion and/or the palm portion of the handwear or glove.

In embodiments where the adhesive is not used on the back hand portion or the palm portion of the handwear or glove, this increases the flexibility of the handwear because the insert can move with respect to the shell and the liner. In one embodiment of the invention the insert is formed with a back panel and a palm panel with the back panel being formed larger than the palm panel to further facilitate flexion of the glove as the glove is closed to a fist shape.

In yet another embodiment the heat activated adhesive is applied to part or all of the finger portions, thumb portions, and part or all of the palm section of the glove. In still further embodiments the adhesive is applied to regions of the back hand portion instead of the palm portion or palm side or to selected regions of the liner or shell, for example with the use of a stencil to predictably limit areas that receive the adhesive.

Figure 4:
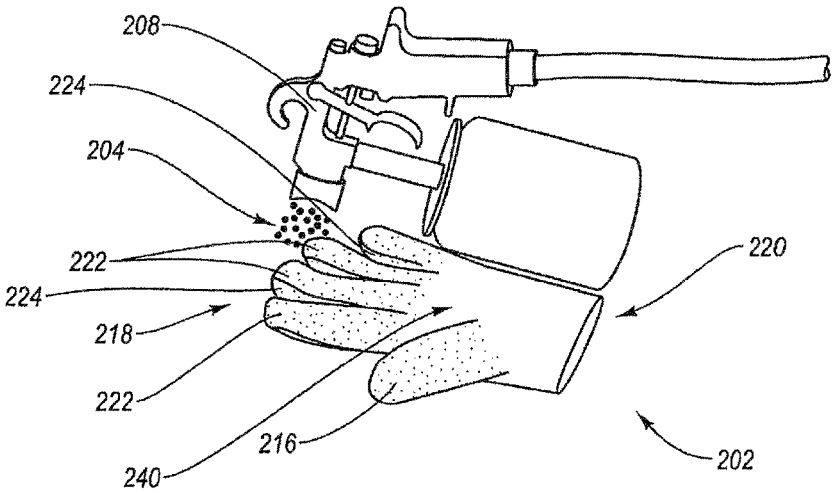
FIG. 4 illustrates the application of adhesive to a glove shell inner surface according to one embodiment of the invention.

With reference now to FIGS. 4-11, one example method of forming water resistant handwear is illustrated therein. As illustrated in FIG. 4, a shell 202 that corresponds to the outer shell 10, 30 of FIGS. 1-2 and the shell 102 of FIGS. 3A-B, is inverted, or turned inside out, so that the shell inner surface 220 (corresponding to shell inner surface 110 in FIG. 3A-B) is exposed in preparation for receiving heat activated adhesive 204 of the type of heat activated adhesive 130, 132 in FIG. 3B discussed above. The heat activated adhesive 204 is then applied with an adhesive applicator 208, such as an aerosol spray applicator, a mechanical applicator, roller, or other adhesive application device or technique as is known in the art. In this embodiment the heat activated adhesive 204 is being applied to the shell inner surface 220 on the finger portions 218, including the fingers 222, the fourchette portions 224, and thumb portion 216 of the shell 202 on the palm side of the shell 202 only. The palm area 240 of the shell 202, however, is not receiving any heat activated adhesive 204. This will increase breathability in the back hand portion of the glove and the palm area 240 of the palm facing side of the shell 202 while obtaining a secure bonding of the heat activated adhesive 204 to the insert 206 in the finger portions 218 and thumb portion 216.

Figure 5:
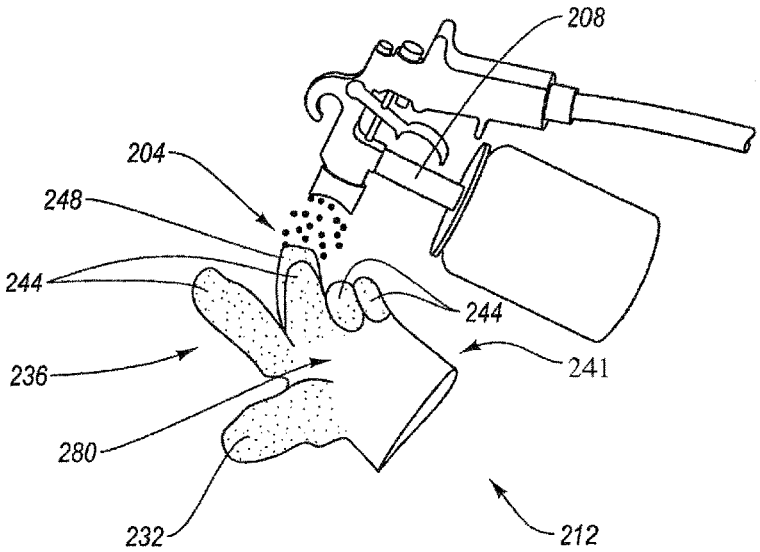
FIG. 5 illustrates the application of adhesive to a glove liner inner surface according to one embodiment of the invention.

As illustrated in FIG. 5, a liner 212 that corresponds to the liner 112 of FIGS. 3A-B, with the liner inner surface 241 (corresponding to liner inner surface 114 in FIG. 3A-B) is exposed in preparation for receiving heat activated adhesive 204 of the type of heat activated adhesive 130, 132 in FIG. 3B discussed above. In other words, the liner 212 is not inverted or presented inside out as the shell 202 is as discussed above. The liner 212 and all the elements therein are sized to register with the corresponding element of the shell 202 and the insert 206.

The heat activated adhesive 204 is then applied with an adhesive applicator 208. In this embodiment the heat activated adhesive 204 is being applied to the liner inner surface 241 on the finger portions 236, including the fingers 244, the fourchette portions 248, and thumb portion 232 of the liner 212 on the palm side of the liner 212 only. The palm area 280 of the liner 212, however, is not receiving any heat activated adhesive 204. This will increase breathability in the back hand portion of the glove and the palm area 280 of the palm facing side of the liner 212 while obtaining a secure bonding of the heat activated adhesive 204 to the insert 206 in the finger portions 236 and thumb portion 232.

Figure 6:
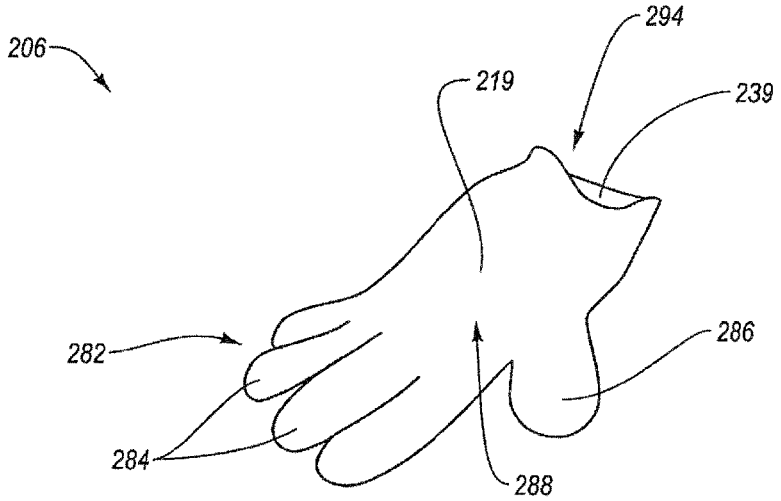
FIG. 6 illustrates a water resistant breathable glove insert according to one embodiment of the invention.

As discussed above, in another embodiment, the heat activated adhesive 204 only is applied to the side portions, or fourchette regions 224, 248 of the shell 202 and liner 212, respectively to adjacent sections of the insert 206 (FIGS. 6-7B), as will be discussed in further detail below. In another embodiment, the heat activated adhesive 204 is used to bond the finger portions 218, 236, including any individual fingers 222, 244, if present, and thumb portion 216, 232, if present, of the shell 202 and the liner 212, respectively (FIGS. 4-5) to the insert 206 (FIGS. 6-7B). In another embodiment, the heat activated adhesive is applied to part or all of the finger portions 218, 236 and thumb portions 216, 232, as well as part or all of the palm areas 240, 280 of the shell 202 and liner 212, respectively. In still further embodiments, the heat activated adhesive 204 is applied to regions of the back hand portion instead of the palm area or to selected regions of the liner 212 or shell 202, for example with the use of a stencil to predictably limit areas that receive the heat activated adhesive 204.

More generally, as best observable in FIGS. 4-7B, an insert 206 made of the type of material illustrated in insert 106 in FIGS. 3A and 3B, is preferably formed as two opposing water resistant and/or breathable membranes that are sealed at their edges to form a hand shaped baggy that mirrors the shape of the shell 202 (illustrated in FIG. 4) and the liner 212 (illustrated in FIG. 5). More particularly, the insert 206 has a first surface 219 (FIG. 6) oriented towards the shell inner surface 220 of the shell 202 (FIG. 4). The first surface 219 corresponds to the first surface 118 of the insert 106 illustrated in FIGS. 3A-B. Insert 206 also includes a second surface 239 oriented towards the liner inner surface 241 (FIG. 5). The second surface 239 corresponds to the second surface 120 of the insert 106 illustrated in FIGS. 3A-B. The insert 206 and all the elements therein are sized to register with the corresponding element of the shell 202 and the liner 212.

While the heat activated adhesive 204 is applied to the shell inner surface 220 and liner inner surface 241 in FIGS. 4-5 discussed above, it will be understood that the heat activated adhesive 204 can be alternatively and/or additionally applied to the insert 206 in various embodiments of the invention. For example, the heat activated adhesive 204 can be applied to the finger portions 282, including any individual fingers 284, if present, and thumb portion 286, if present, on one or both of the first surface 219 and second surface 239. Of course, it will be understood that the insert 206 will have to be turned inside out to apply the heat activated adhesive 204 to the second surface 239. Other embodiments include applying the heat activated adhesive 204 to a palm area 288 of the insert 206.

Conventionally, water resistant insert/baggies 206 are typically formed to a much greater size than is necessary to accommodate folds and movements of the insert 206. This is not necessary due to the adhesive methods and structures disclosed herein. In contrast, preferred inserts 206 according to the invention are custom patterned and formed to much more closely match the size of the final glove. In addition, conventional water resistant gloves uses stitching at the fingertips of the glove to hold the insert and liner in place. This is not necessary with the adhesive methods and structures disclosed herein.

Figure 7A:
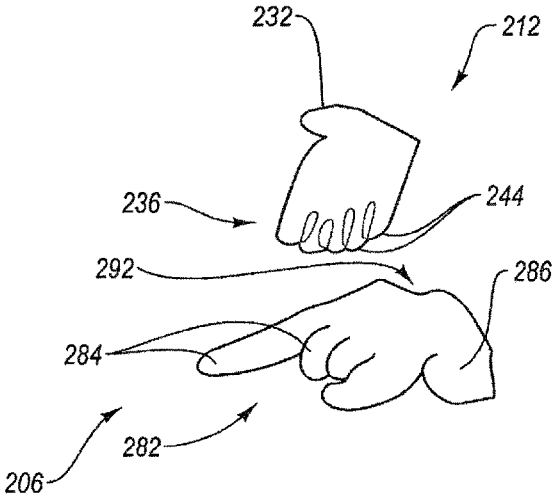
FIG. 7A illustrates a glove liner being inserted into a glove insert according to one embodiment of the invention.
Figure 7B:
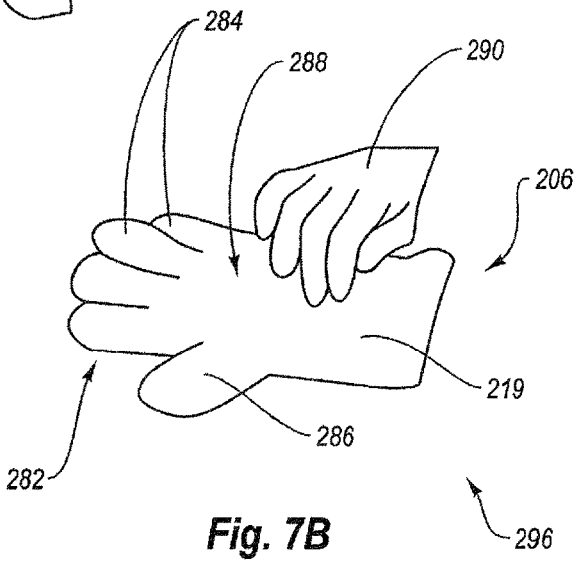
FIG. 7B illustrates a glove insert into which a glove liner has been inserted according to one embodiment of the invention.

In FIGS. 6, 7A, and 7B, an insert 206 is shown and the act of inserting the partially adhesive-coated liner 212 of FIG. 5 into the insert 206 is shown. More particularly, the liner 212 is inserted into the insert 206 along the direction of the arrow 292 through a wrist opening 294 so that the finger portion 236 with any fingers 244 and thumb portion 232 of the liner 212 lie adjacent to the finger portion 282 with any fingers 284 and thumb portion 286 of the insert 212. This process can occur by a person's hand, such as hand 290 illustrated in FIG. 7B or through an automated process.

In FIG. 7B, the combined liner/insert 296 has the insert 206 smoothed over the inserted liner 212 (not shown) to reduce, minimize, and, preferably, eliminate any gathering or bunching of the insert 206 over the liner 212. Although FIG. 7B illustrates a hand 290 of a person, it will be understood that this process can occur through an automated process.

In a next step that is not shown, the inverted shell 202 of FIG. 4 is drawn over the combined liner/insert 296 of FIG. 7 and turned rightside out during the process so the shell outer layer corresponding to the outer surface of the outer shell 10, 30 in FIGS. 1-2 is facing outward and the shell inner layer 220 with the heat activated adhesive 204 is facing the combined liner/insert 296. Alternatively, the inverted shell 202 can be first turned rightside out and the combined liner/insert 296 inserted into the shell 202 in a manner similar to that in which the liner 212 was inserted into the insert 206 in FIGS. 7A-B.

Further embodiments include combining the shell 202 with the insert 206 first, and then joining the liner 212 as would be understood from this disclosure.

Figure 8:
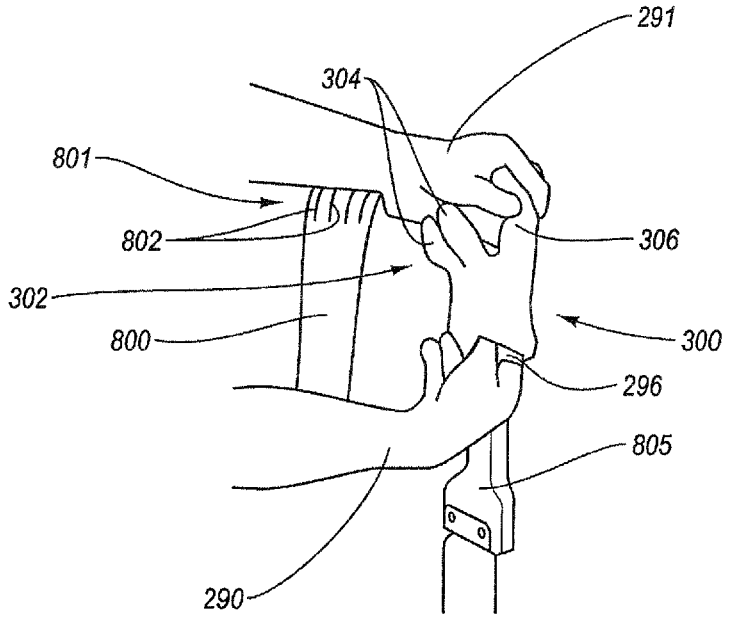
FIG. 8 illustrates the placement of the thumb portion of an assembled but not yet bonded glove on a thumb form according to the methods of the invention.
Figure 9:
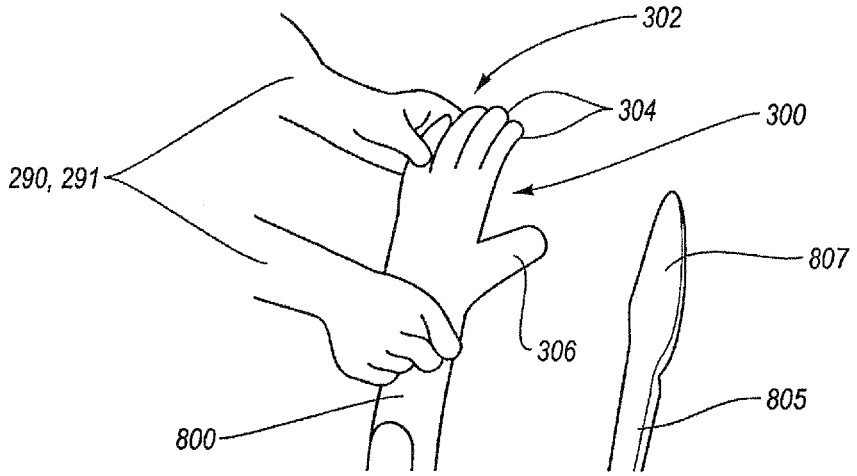
FIG. 9 illustrates the placement of the fingers portion of an assembled but not yet completely bonded glove on a four finger form according to one embodiment of the invention.

In FIGS. 8-9, a handwear shaping mandrel, or iron, 800 with finger portion 801 and optional fingers 802 (four finger mandrel in this embodiment), and a thumb shaping mandrel, or iron, 805, with thumb portion 807 are shown. In FIG. 8, the thumb portion 306 of the assembled but not yet bonded glove 300 that includes the combined liner/insert 296 and shell 202 is placed on the thumb shaping iron 805 by hands 290, 291 of a person, although it will be understood that this process can be automated. In a preferred embodiment the combined liner/insert 296 is smoothed out between the liner 212 and the shell 202. The thumb shaping iron 805 is then heated to a target temperature range for the target time range to activate or cure the heat activated adhesive 204 in the thumb portion 306 and bond the shell 202, insert 206, and liner 212 layers therein. Of course, it will be understood that heating the thumb shaping iron, or mandrel, 805 can occur concurrently with the heating and pressing step illustrated in FIG. 11 and discussed below.

Figure 10:
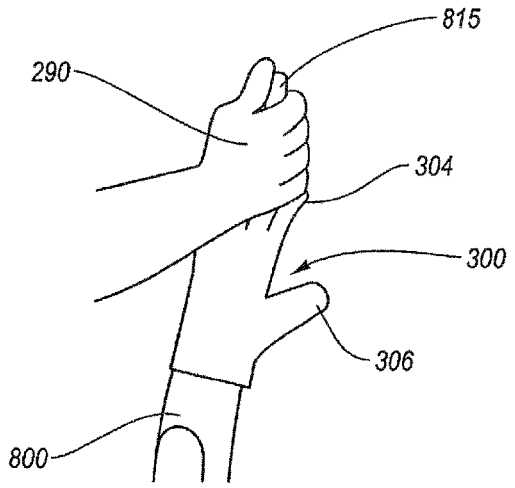
FIG. 10 illustrates smoothing of wrinkles out of the liner in an assembled but not yet completely bonded glove according to one embodiment of the invention.

In FIG. 9 the finger portion 302 with any fingers 304 of the glove are placed over the handwear shaping iron 800 and the iron 800 is heated to the target temperature for the target time to activate or cure the heat activated adhesive 204 wherever present in the remainder of the glove 300 and bond the shell 202, liner 206, and liner 212 layers therein. A smoothing tool 815 illustrated in FIG. 10 is preferably used to eliminate wrinkles, bunching, and gathering between the shell 202, the insert 206, and liner 212 layers therein and enhance alignment of adjacent portions and areas throughout the assembly process.

The target temperature is a temperature higher than that which is encountered by a user in normal activities but lower than the melt or burn temperatures of the other materials used to form the glove 300. The target time is determined by the adhesive material selected. In one preferred embodiment the handwear shaping mandrel, or iron, 800 and thumb shaping mandrel, or iron, 805 are heated to a range of from about 150 degrees Fahrenheit to about 250 degrees Fahrenheit for a period of from about 5 seconds to about 45 seconds. In another example the handwear shaping mandrel, or iron, 800 and thumb shaping mandrel, or iron, 805 are heated to a temperature of about 284 degrees Fahrenheit for about 30 seconds.

Figure 11:
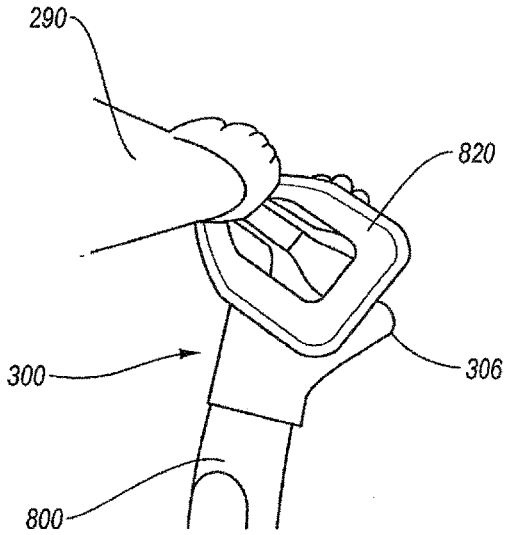
FIG. 11 illustrates one method of heating a glove according to one embodiment of the invention.

Finally, in FIG. 11 a steam iron 820 is used to smooth the glove assembly 300 and assure that the heat activated adhesive 204 is set. It is also preferred to leave the glove 300 on the handwear shaping iron 800 for a period of time, such as two minutes, that is sufficient to help form the appropriate glove shape as the heat activated adhesive 204 sets. Of course, it will be understood that pressing the glove 300 with the iron 820 can occur concurrently with the process of heating the thumb shaping iron, or mandrel, 805 illustrated in FIGS. 8-9 discussed above. Further, it will be understood that while FIG. 11 illustrates a manual process, this process can be automated and can include two separate irons 820, one for each side of the glove 300, to quicken the process. Further, an alternative embodiment uses heated platens instead of a manual iron 820.

The one or more present inventions, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. Handwear to be worn on the hand of user wherein the hand has fingers, a palm, and a back of the hand opposite the palm, said handwear comprising:

a shell formed from material defining an interior including a shell palm portion sized to receive the palm and back of a hand of a user, said shell including shell fingers formed of multiple pieces of material joined together, said shell fingers being sized to receive the fingers of the hand of the user, said shell having a shell outer surface which is an outer surface of said handwear and a shell inner surface opposite said shell outer surface;

a liner formed of a material which is configured to inhibit the transfer of heat from the hand of said user, said liner having a liner outer surface and a liner inner surface opposite said liner outer surface, said liner including a liner palm portion for positioning against the palm and a liner back portion for positioning against the back of said hand and liner fingers to receive said fingers and to register with said shell fingers;

an insert formed of a material which is water resistant and breathable for the passage of moisture therethrough, said insert having a first insert surface for orientation towards said shell inner surface and a second insert surface for orientation towards said liner inner surface, said insert including insert fingers sized to register with said shell fingers and said liner fingers and an insert palm portion sized to register with said shell palm portion and said liner palm portion;

a first portion of adhesive in the form of a powder or a liquid that is applied as an aerosol to form a first portion coating which first portion coating is applied to one of said shell inner surface of said shell fingers and said first insert surface of said insert fingers and not on said shell inner surface of said shell palm portion and said first insert surface of said insert palm portion, and said first portion coating being changeable from said powder or liquid after it is applied to a bonding condition upon application of heat, wherein said first portion coating as said powder or liquid after it is applied and before said application of heat does not inhibit relative movement of said shell inner surface of said shell fingers with respect to said first insert surface of said insert fingers, and wherein said first portion coating in said bonding condition bonds said shell inner surface of said shell fingers and said first insert surface of said insert fingers; and a second portion of adhesive in the form of a powder or a liquid that is applied as an aerosol to form a second portion coating which is not an adhesive strip or tape with adhesive thereon and which second portion coating is applied to and about one of said liner inner surface of said liner fingers and said second insert surface of said insert fingers and not to any other portion of said liner inner surface and said second insert surface, and said second portion of adhesive being changeable from said powder or liquid after it is applied to a bonding condition upon application of heat, wherein said second portion coating as said powder or liquid after it is applied does not inhibit relative movement of said liner inner surface of said liner fingers and said second insert surface of said insert fingers, and wherein said second portion coating in said bonding condition bonds said liner inner surface of said liner fingers and said second insert surface of said insert fingers.

2. The handwear of claim 1, wherein each of said shell, said liner, and said insert includes a thumb portion.

3. The handwear of claim 2, wherein said first portion layer is positioned between said shell inner surface at said shell thumb portion and said first insert surface at said insert thumb portion, and said second portion layer is positioned between said liner inner surface at said liner thumb portion and said second insert surface at said insert thumb portion.

4. Handwear to be worn on the hand of user wherein the hand has a palm, a back of the hand opposite the palm and fingers, said handwear comprising:

a shell layer having an interior including a shell palm portion sized to receive the palm and back of a hand of a user, four shell finger members each sized to receive the fingers of the hand of the user, said shell having a shell outer surface which is an outer surface of said handwear and a shell inner surface opposite said shell outer surface and said four shell finger members each having at least one shell fourchette portion;

a liner formed of a material which is configured to inhibit the transfer of heat from the hand of said user, said liner having a liner outer surface and a liner inner surface opposite said liner outer surface, said liner including a liner palm portion for positioning against the palm and a liner back portion for positioning against the back of said hand, and said liner including four liner finger members each sized to receive said fingers and each positioned to register with one of said four shell finger members;

an insert formed of a material which is water resistant and breathable for the passage of moisture therethrough, said insert having a first insert surface for orientation towards said shell inner surface and a second insert surface for orientation towards said liner inner surface, said insert including four insert finger members each positioned and sized to register with one of said four shell finger members and one of said four liner finger members and an insert palm portion sized to register with said shell palm portion and said liner palm portion;

a first portion of adhesive in the form of a powder or a liquid which is applied directly as an aerosol to form a first portion layer on one of said shell inner surface of said shell finger members and said first insert surface of said insert finger members and not on said shell inner surface of said shell palm portion and said first insert surface of said liner palm portion, said first portion layer being configured to be changed from said powder or liquid to a bonding condition upon application of heat, wherein said first portion layer as said powder or liquid after it is applied does not inhibit relative movement of said shell inner surface of said shell finger members with respect to said first insert surface of said insert finger members when said first portion layer is positioned on only one of said shell inner surface of said shell finger members and said first insert surface of said insert finger members, and wherein said first portion layer in said bonding condition bonds said shell inner surface of said shell finger members and said first insert surface of said insert finger members;

a second portion of adhesive in the form of a powder or liquid that is applied directly as an aerosol to form a second portion layer and which is on only one of said liner inner surface of said liner finger members and said second insert surface of said insert finger members and not to any other portion of said liner inner surface and said second insert surface, said second portion layer being changed from said powder or liquid to a bonding condition upon application of heat, wherein said second portion layer as said powder or liquid as applied does not inhibit relative movement of said second insert surface relative to said liner inner surface, and wherein said second portion layer bonding condition bonds said liner inner surface of said liner finger members and said second insert surface of said insert finger members.

5. Handwear to be worn on the hand of user wherein the hand has a palm, a back of the hand opposite the palm and fingers, said handwear comprising:

a shell having a shell body portion sized to receive a palm portion with a back of the hand of a user, said shell having a shell outer surface which is an outer surface of said handwear and a shell inner surface opposite said shell outer surface, said shell including shell fingers to receive said fingers of said user, said shell fingers being formed from multiple pieces having a length and a width stitched together;

a liner formed of a material configured to inhibit a transfer of heat from the hand of said user when positioned in said liner, said liner having a liner outer surface for positioning against said hand of said user and a liner inner surface opposite said liner outer surface, said liner including liner fingers sized to register with said shell fingers and a liner body portion sized to register with the shell body portion;

an insert which is water resistant and breathable for the passage of moisture therethrough, said insert having a first insert surface for orientation towards said shell inner surface and a second insert surface for orientation towards said liner inner surface, said insert including insert fingers sized to register with both said shell fingers and said liner fingers and an insert body portion sized to register with the shell body portion;

a first portion of adhesive positioned as a coating which is on one of said shell inner surface of shell fingers and said first insert surface of said insert fingers and not to said shell inner surface of said shell body portion and said first insert surface of said insert body portion, said first portion of adhesive being transformable from a powder or liquid as a coating which does not inhibit movement of said shell inner surface of said shell fingers relative to said first insert surface of said insert fingers when positioned on only one of said shell inner surface of said shell fingers and said first insert surface of said insert fingers, and to a bonding condition which bonds said shell inner surface of said shell fingers and said first insert surface of said insert fingers when heated and then cooled; and a second portion of adhesive positioned as a coating which is not an adhesive strip or tape and on and about only one of said liner inner surface of said liner fingers and said second insert surface of said insert fingers and not to said liner inner surface of said liner body portion and said second insert surface of said insert body portion, said second portion of adhesive being transformable from a powder or a liquid as a coating which does not inhibit movement between said liner inner surface of said liner fingers and said second insert surface of said insert fingers when attached to only one of liner inner surface of said liner inner surface and said second insert surface of said insert finger portion to a bonding condition which bonds said liner inner surface of said liner fingers and said second insert surface of said insert fingers when heated and then cooled.

6. The handwear of claim 5, wherein each of said shell fingers, said liner fingers, and said insert fingers are configured to receive a single finger of said hand of said user.

7. The handwear of claim 6, wherein each of said shell, said liner and said insert include a thumb portion.

8. The handwear of claim 7, wherein each said shell finger portion includes at least one fourchette portion.

9. The handwear of claim 8, wherein said each shell finger portion includes at least two fourchette portions.

10. Handwear comprising:

a shell layer having an interior sized to receive a palm, a back of the hand and fingers of a hand of a user, said shell having a shell outer surface which is an outer surface of said handwear and a shell inner surface opposite said shell outer surface, said shell including a shell finger portion having a plurality of shell finger members each formed with a shell fourchette member with each of said shell finger members sized to receive said fingers of said user and a shell body portion to receive said palm and back of the hand of said user, and said shell layer being formed from multiple pieces stitched together;

a liner having a liner outer surface for positioning against said hand of said user and a liner inner surface opposite said liner outer surface, said liner including a liner finger portion having a plurality of liner finger members sized to register with and insert into said shell finger members and said liner including a liner body portion sized to register with said shell body portion;

an insert which is water resistant and breathable, said insert having a first insert surface for orientation towards said shell inner surface and a second insert surface for orientation towards said liner inner surface, said insert including an insert finger portion having a plurality of insert finger members sized to register with and insert into each of said shell finger members and sized to receive each of said liner finger members and an insert body portion sized to register with said shell body portion;

a first portion of adhesive configured to be sprayed by an aerosol applicator to form a coating positioned on part of one of said shell inner surface of said shell finger portion and said first insert surface of said insert finger portion and not to said shell inner surface of said shell palm portion and said first insert surface of said insert palm portion, said first portion of adhesive being transformable from said coating which does not inhibit movement of said shell inner surface of said shell finger portion relative to said first insert surface of said insert finger portion when positioned on only one of said shell inner surface of said shell finger portion and said first insert surface of said insert finger portion to bonding condition in which said first portion of adhesive bonds said shell inner surface of said shell finger portion and said first insert surface of said insert finger portion upon application of heat; and a second portion of adhesive configured to be sprayed by an aerosol applicator to form a coating on one of said liner inner surface of liner finger portion and said second insert surface of said insert finger portion and not to the body portion of said liner inner surface and not to said body portion of said second insert, said second portion of adhesive being changed from said coating which does not inhibit movement of said inner surface of said liner finger portion relative to said second insert surface of said insert finger portion when positioned to only one of said liner inner surface of liner finger portion and said second insert surface of said insert finger portion to a bonding condition which said second portion of adhesive bonds said liner inner surface of liner finger portion and said second insert surface of said insert finger portion upon application of heat.

11. The handwear of claim 10, wherein said first portion of adhesive and said second portion of adhesive are powders.

12. The handwear of claim 10, wherein said first portion of adhesive and said second portion of adhesive are both a liquid.

13. Handwear to be worn on the hand of user wherein the hand has fingers, a palm, and a back of the hand opposite the palm, said handwear comprising:

a shell layer having an interior including a shell palm portion sized to receive the palm and back of a hand of a user and shell fingers sized to receive the fingers of the hand of the user, said shell having a shell outer surface which is an outer surface of said handwear and a shell inner surface opposite said shell outer surface, said shell fingers being formed from multiple pieces joined together;

a liner formed of a material which is configured to inhibit the transfer of heat from the hand of said user, said liner having a liner outer surface and a liner inner surface opposite said liner outer surface, said liner including a liner palm portion for positioning against the palm and a liner back portion for positioning against the back of said hand and liner fingers to receive said fingers and to register with said shell fingers;

an insert formed of a material which is water resistant and breathable for the passage of moisture therethrough, said insert having a first insert surface for orientation towards said shell inner surface and a second insert surface for orientation towards said liner inner surface, said insert including insert fingers sized to register with said shell fingers and said liner fingers and an insert palm portion sized to register with said shell palm portion and said liner palm portion;

a first portion of adhesive in the form of a powder or a liquid that is applied as an aerosol and not as a strip or tape with adhesive thereon to form a first portion coating which first portion coating is applied to one of said shell inner surface of said shell fingers and said first insert surface of said insert fingers and not on said shell inner surface of said shell palm portion and said first insert surface of said insert palm portion, and said first portion coating being changeable from said powder or liquid after it is applied to a bonding condition upon application of heat, wherein said first portion coating as said powder or liquid after it is applied and before said application of heat does not inhibit relative movement of said shell inner surface of said shell fingers with respect to said first insert surface of said insert fingers, and wherein said first portion coating in said bonding condition bonds said shell inner surface of said shell fingers and said first insert surface of said insert fingers; and a second portion of adhesive in the form of a powder or a liquid that is applied as an aerosol to form a second portion coating which is not an adhesive strip or tape with adhesive thereon and which second portion coating is applied to and about one of said liner inner surface of said liner fingers and said second insert surface of said insert fingers and not to any other portion of said liner inner surface and said second insert surface, and said second portion of adhesive being changeable from said powder or liquid after it is applied to a bonding condition upon application of heat, wherein said second portion coating as said powder or liquid after it is applied does not inhibit relative movement of said liner inner surface of said liner fingers and said second insert surface of said insert fingers, and wherein said second portion coating in said bonding condition bonds said liner inner surface of said liner fingers and said second insert surface of said insert fingers.

14. A method for forming handwear which is water resistant and breathable, said method comprising:

providing a shell having an interior sized to receive the palm, back portion and the fingers of a hand of a user, said shell having a shell outer surface which is an outer surface of said handwear and a shell inner surface opposite said shell outer surface, wherein said shell includes a shell finger portion formed from multiple pieces to receive said fingers of said user, a shell palm portion, and a shell back portion to receive said palm portion and back portion of said hand of said user;

providing a liner sized to fit into and register with said shell, said liner having a liner outer surface for positioning against said hand of a user including the palm and the back portion of the hand of the user and a liner inner surface opposite said liner outer surface, said liner outer surface and said liner inner surface including a liner finger portion sized to register with said shell finger portion, a liner palm portion sized to align with the palm portion of the hand of a user, and a liner back portion sized to align with the back portion of the hand of a user;

providing an insert sized to fit into and register between and with said shell and said liner, said insert being formed of a material which is water resistant and breathable, said insert having a first insert surface for orientation towards the shell inner surface and a second insert surface for orientation towards the liner inner surface, said first insert surface and said second insert surface including an insert finger portion sized to register with and between said shell finger portion and said liner finger portion, an insert palm portion sized to register with said liner palm portion, and an insert back portion sized to register with said shell back portion;

providing and applying a heat activated adhesive in the form of a powder or liquid as an aerosol on one of said liner inner surface at said liner finger portion and said second insert surface of said insert at said insert finger portion without applying heat activated adhesive to both of said liner inner surface at said liner back portion and said second insert surface at said insert palm portion;

providing and applying a heat activated adhesive in the form of a powder or liquid as an aerosol on one of said shell inner surface at said shell finger portion and said first insert surface of said insert at said insert finger portion without applying heat activated adhesive to said first insert surface of said insert at said insert back portion and to said shell inner surface of said shell at said shell palm portion;

assembling said insert with said liner and said shell to position said second insert surface of said insert at said insert finger portion adjacent to said liner inner surface at said liner finger portion, said first insert surface of said insert at said insert finger portion is adjacent to said shell inner surface at said shell finger portion, said second insert surface of said insert at said insert palm portion is proximate said liner inner surface at said liner palm portion, and said first insert surface of said insert at said insert back portion is proximate said inner surface of said shell at said shell palm portion; and causing said adhesive of said assembled shell, insert, and liner to bond said insert at said insert finger portion to each of said shell finger portion and said liner finger portion without bonding said insert to said liner back portion and said second insert surface without bonding said insert to said shell between said shell back portion and said liner back portion.

* * * * *